US009181785B2

(12) United States Patent
Lawson et al.

(10) Patent No.: US 9,181,785 B2
(45) Date of Patent: Nov. 10, 2015

(54) AUTOMATIC BYPASS FOR ESP PUMP SUCTION DEPLOYED IN A PBR IN TUBING

(75) Inventors: Peter F. Lawson, Tulsa, OK (US); Donald P. Lauderdale, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 721 days.

(21) Appl. No.: 13/236,188

(22) Filed: Sep. 19, 2011

(65) Prior Publication Data

US 2012/0132414 A1 May 31, 2012

Related U.S. Application Data

(60) Provisional application No. 61/417,974, filed on Nov. 30, 2010.

(51) Int. Cl.
*E21B 43/12* (2006.01)
*F04B 47/06* (2006.01)

(52) U.S. Cl.
CPC ..... *E21B 43/128* (2013.01); *F04B 47/06* (2013.01)

(58) Field of Classification Search
CPC ..... E21B 43/12; E21B 43/128; F04B 47/06; F04B 17/03; F04B 35/04; F04B 43/04; F04B 39/121
USPC ..... 166/105, 68, 369
See application file for complete search history.

(56) References Cited

U.S. PATENT DOCUMENTS 3,907,046 A 9/1975 Gaylord
4,440,221 A * 4/1984 Taylor et al. ..... 166/106
4,749,044 A 6/1988 Skipper et al.
6,289,990 B1 9/2001 Dillon et al.
6,508,308 B1 1/2003 Shaw
6,540,020 B1 4/2003 Falgout, Sr.
6,571,856 B1 6/2003 Popelar et al.
6,571,876 B2 6/2003 Szarka
6,595,295 B1 7/2003 Berry et al.
6,598,681 B1 7/2003 Berry
7,048,057 B2 5/2006 Bearden et al.
7,228,914 B2 * 6/2007 Chavers et al. ..... 166/386
7,363,983 B2 4/2008 Martinez et al.
7,431,093 B2 10/2008 Bearden et al.
2001/0042626 A1 11/2001 Patel
2004/0159447 A1 8/2004 Bissonnette et al.
2006/0225893 A1 10/2006 Coon et al.
2007/0274849 A1 * 11/2007 Martinez ..... 417/423.3

FOREIGN PATENT DOCUMENTS

GB 2411416 8/2005
WO 0214650 2/2002
WO 2007026141 3/2007
WO 2007083192 7/2007

* cited by examiner

*Primary Examiner* — Yong-Suk (Philip) Ro
(74) *Attorney, Agent, or Firm* — Steve Rosenblatt

(57) ABSTRACT

A subterranean pump is delivered on coiled tubing with power and control cables running inside. The pump suction has a tubular inlet that seals in a polished bore in the surrounding tubular. A diverter opens a lateral port and closes entry to the pump suction when the pump is not running and the formation pressure is high enough to bring production to the surface. This configuration prevents the pump from turning while the formation pressure allows production to the surface. If the pump is started it reduces pressure ahead of a movable plug to draw it toward the pump against a spring bias. The lateral ports close and an inline flow path opens to allow the pump to draw through the diverter and discharge into the annular space around the coiled tubing on the way to the surface.

17 Claims, 3 Drawing Sheets

AUTOMATIC BYPASS FOR ESP PUMP SUCTION DEPLOYED IN A PBR IN TUBING

CROSS REFERENCE TO RELATED APPLICATION

This application is claims priority from U.S. Provisional Patent Application Ser. No. 61/417,974 for "Automatic Bypass for ESP Pump Suction Deployed in a PBR in Tubing", filed on Nov. 30, 2010, the disclosure of which is incorporated herein by reference in its entirety.

FIELD OF THE INVENTION

The field of the invention is installations of electric submersible pumps (ESP) in applications where the pump suction is connected to a tubular polished bore and the discharge is directed in an annular space around a string that delivers and houses the power and control cables for the ESP and more particularly an automatic flow diverter located on the suction side of the ESP.

BACKGROUND OF THE INVENTION

When ESPs are installed in a wellbore they are not always operated. If the formation has enough pressure to produce on its own without the need for the pump to run then the pump is left off. The problem has been that the formation produces particles that can settle if production is stopped for any reason and accumulate in the pump. The large deposit of solids in the ESP can cause damage when the pump is later turned on. The shaft can break from being over-torqued or the impellers can get jammed and not turn.

Diverters have been put in the discharge of the ESP that use the pressure developed by the ESP to shift a sleeve to close a lateral port while at the same time opening a path between the pump discharge and the diverter that is a through path for pumped fluids. Conversely when the pump is turned off the reduction of internal pressure allows a sleeve to shift to open a lateral port through the diverter while closing the through port back to the ESP. What this does is to redirect the settling debris or particles out of the discharge piping just above the ESP discharge connection and send the solids back into the wellbore rather than into the pump discharge where they can later cause damage when the pump is restarted.

Some examples of flow responsive diverter valves include: GB 2,411,416 A; WO 02/14650; U.S. Pat. Nos. 6,571,856; 4,749,044; 3,907,046; US 2004/0159447; US 2006/0225893; US 2001/0042626; U.S. Pat. Nos. 6,540,020; 6,595,295 and 6,571,876. Other techniques to protect and ESP from debris accumulation when it is not running are shown in U.S. Pat. Nos. 7,048,057 and 7,431,093 and US Publication 2007/0274849; WO2007/083192; WO2007/026141 and U.S. Pat. No. 6,289,990. Also of general interest is U.S. Pat. No. 6,508,308.

These devices worked well when installed in the pump discharge piping but not all installations involved a pressurized discharge line from the pump. In some cases the pump was installed inside a tubular string such that its suction line entered a polished bore receptacle (PBR). The pump was positioned in the subterranean location with a string such as coiled tubing that had power and instrumentation cables inside the coiled tubing. The pump discharge was into the annular space around the coiled tubing rather than through the coiled tubing. In such applications the known diverter valves would not function for their intended purpose as that purpose was only accomplished when such known diverters were in the discharge line of a pump where an interruption of pump operation allowed solids to move by gravity potentially into the inside of the pump through the discharge line.

The present invention addresses this different situation where the discharge of the pump is an annular space and provides a way to isolate the pump suction when the pump is off while allowing a reconfiguration urged by the startup of the pump to move a sleeve to overcome a bias so that a lateral port is closed and flow can enter the pump suction around an internal movable barrier. Those skilled in the art will better appreciate the details of the invention from a review of the detailed description of the preferred embodiment and the associated drawings while recognizing that the full scope of the invention is to be determined from the appended claims.

SUMMARY OF THE INVENTION

A subterranean pump is delivered on coiled tubing with power and control cables running inside. The pump suction has a tubular inlet that seals in a polished bore in the surrounding tubular. A diverter opens a lateral port and closes entry to the pump suction when the pump is not running and the formation pressure is high enough to bring production to the surface. This configuration prevents the pump from turning while the formation pressure allows production to the surface. If the pump is started it reduces pressure ahead of a movable plug to draw it toward the pump against a spring bias. The lateral ports close and an inline flow path opens to allow the pump to draw through the diverter and discharge into the annular space around the coiled tubing on the way to the surface.

DETAILED DESCRIPTION OF THE PREFERRED EMBODIMENT

Figure 1:
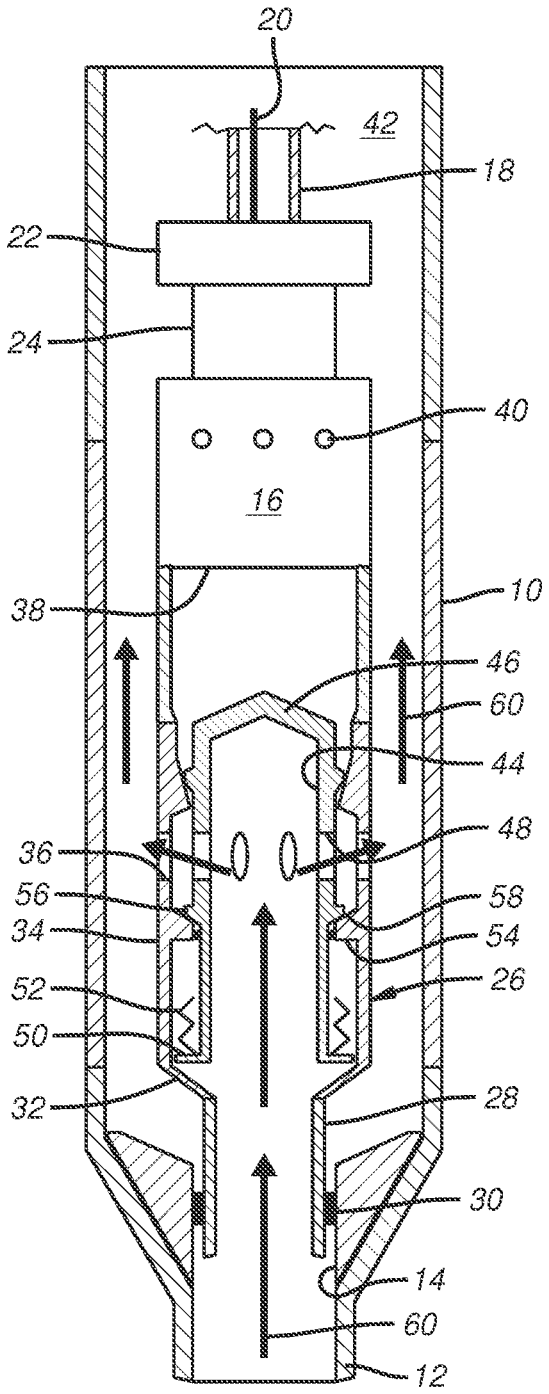
FIG. 1 is a view of the pump assembly when the pump is not running that shows formation fluid bypassing the pump in an annular space around the pump and within the surrounding tubular.

Referring to FIG. 1, a tubular string 10 extends to a subterranean location and has a lower end 12 in fluid communication with a producing zone that is not shown. A polished bore 14 is located near the lower end 12. The ESP 16 is supported by a coiled tubing string 18 inside of which runs a power and control cable(s) shown collectively as 20. Motor 22 is connected to the ESP 16 through a seal 24.

A diverter assembly 26 has an elongated inlet 28 with external seals 30 to engage the polished bore receptacle 14. A transition 32 leads to a housing 34 that has one or more wall ports 36. The housing continues to the suction side 38 of the pump 16. One or more discharge ports 40 allow pump discharge from the ESP 16 to exit into annulus 42. Inside the housing 34 is a generally cylindrically shaped diverter member 44 that has a closed top 46 and lateral ports 48. The diverter 44 has a lower exterior flange 50 on which a biasing member 52 pushes down while braced off surface 54 within housing 34. A lower exterior ring or other projection 56 lands on surface 58 as a travel stop under the force of bias from spring 52. Arrows 60 represent formation flow path when the pump 16 is not running. The flow is into the inlet 28 and then through ports 48 and 36 and into the annular space 42 to the surface. Since the inlet 38 is pressure equalized with the discharge ports 40, no debris with the produced fluid goes into the pump 16. Additionally, in this configuration the flow does not turn the pump when the pump is not running as the suction and discharge of the pump are in pressure balance to the flow from the formation that bypasses the stopped pump. Operation at high flow rates without the pump operating can, without the present invention, cause the pump to turn and wear the bearings especially the upper thrust bearings or running surfaces. The diverter assembly 26, when the pump discharges to an annular space around a string 18, not only keeps debris out of the pump but prevents premature wear on the bearings and other rotating components.

Figure 2:
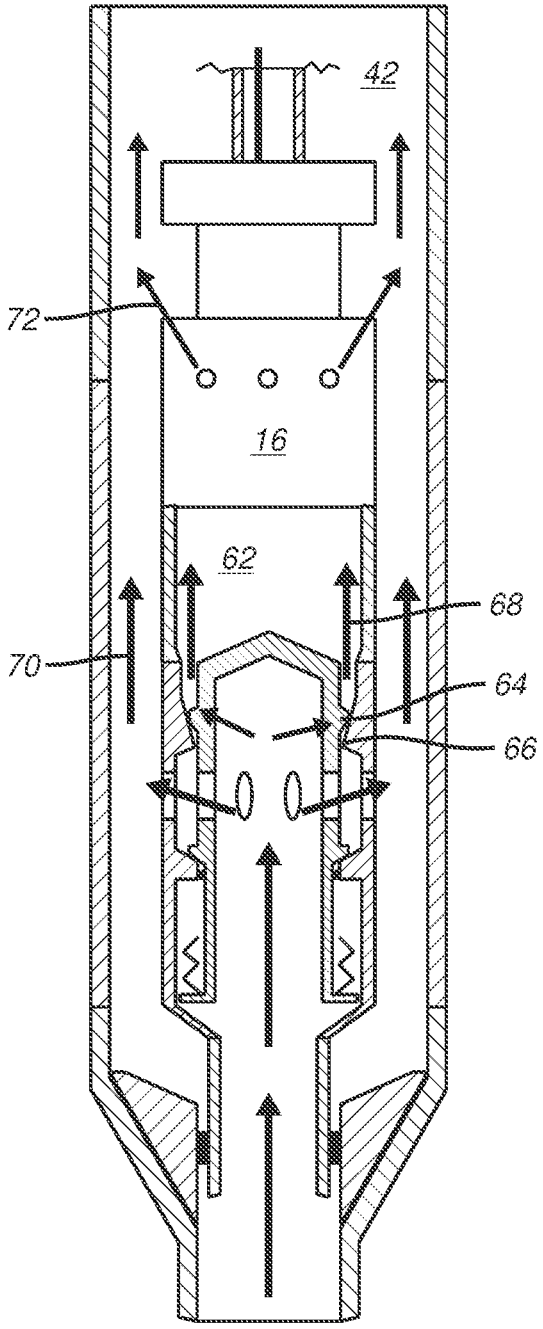
FIG. 2 is the view of FIG. 1 with the pump just started and beginning to move the element in the diverter.

In FIG. 2 the pump 16 has just started and it starts to reduce the pressure in zone 62 to induce flow around upper outer ring 64 as ring 64 is raised away from taper 66 and the spring 52 is compressed as the surface 50 rises. For a short time there is flow into the pump 16 represented by arrow 68 and there is flow bypassing pump 16 represented by arrow 70. The pump 16 also begins to discharge through outlets 40 as indicated by arrows 72. The incoming flow impinges the closed top 46 to help raise the diverter assembly 26.

Figure 3:
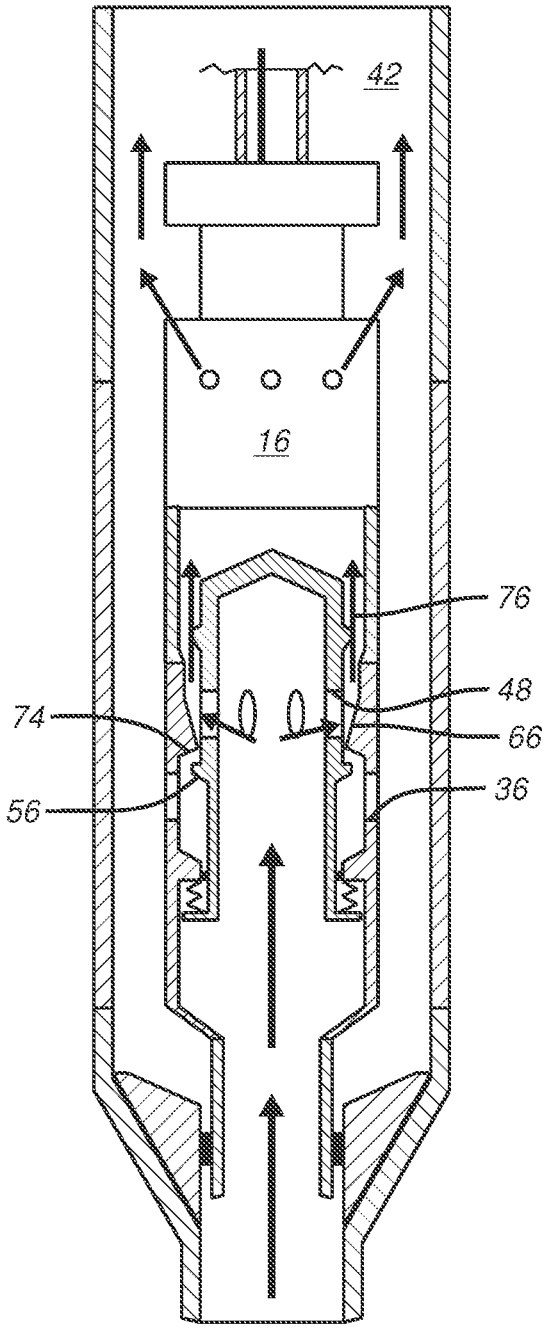
FIG. 3 is the view of FIG. 2 showing completed movement of the element in the diverter so that the lateral ports are closed and the through passage is open.

Within a very short time with the pump 16 running, FIG. 3 shows ports 36 essentially closed by the upward shifting of ports 48 and the rising up of ring 56 close to or against tapered surface 74. The path of least resistance is now through ports 48 and into the pump 16 as indicated by arrows 76.

When the pump 16 is again shut off the FIG. 1 configuration is resumed aided by spring 52.

Those skilled in the art will now appreciate that the diverter of the present invention is uniquely configured to operate on the suction of a pump 16 which can be an ESP of another style of pump such as a progressing cavity for example. It is urged to move to reconfigure the flow scheme using a pressure reduction from starting the pump rather than a pressure increase as in diverters mounted on the pump discharge. The induced flow from starting the pump also aids in lifting the member 26 as flow impinges on the closed end 46. There are opposed travel stops for the condition of the pump running or pump in the off condition.

The above description is illustrative of the preferred embodiment and many modifications may be made by those skilled in the art without departing from the invention whose scope is to be determined from the literal and equivalent scope of the claims below.

We claim:

1. A flow diversion assembly for an electric submersible pump (ESP) supported in a tubular string, comprising:

said ESP supported on a running string for delivery to a predetermined location in said tubular string, said ESP and running string defining an open annulus with said tubular string;

said ESP having an inlet selectively isolated from said annulus with said ESP not running while production flow from an adjacent formation bypasses said ESP and flows toward a surface location using pressure in the adjacent formation and said inlet is open to said annulus with said ESP running so that production flow is fully redirected to the ESP while closing off said bypassing of said ESP, said ESP further comprising an outlet in communication with said annulus.

2. The assembly of claim 1, wherein:

said selective isolation is controlled by a valve.

3. The assembly of claim 2, wherein:

said valve comprises a sliding sleeve.

4. The assembly of claim 3, wherein:

said inlet comprises housing having a wall port;

said housing sealingly engages the tubular string.

5. The assembly of claim 4, wherein:

said sliding sleeve disposed in said housing and having a sleeve port in a wall thereof;

said sliding sleeve port selectively aligned with said wall port of said housing.

6. The assembly of claim 5, wherein:

said sliding sleeve has a closed end adjacent said ESP and a projection located on an opposite side from said sliding sleeve port than said closed end.

7. The assembly of claim 3, wherein:

said valve is operated by a biasing member and is selectively overcome by operation of said ESP.

8. The assembly of claim 1, wherein:

particulates that settle in said annulus bypass said ESP with said ESP off.

9. The assembly of claim 1, wherein:

said running string further comprises coiled tubing with power and control cable running therethrough.

10. The assembly of claim 1, wherein:

said ESP does not rotate in an off position with flow bypassing said ESP.

11. A flow diversion assembly for an electric submersible pump (ESP) supported in a tubular string, comprising:

said ESP supported on a running string for delivery to a predetermined location in said tubular string, said ESP and running string defining an annulus with said tubular string;

said ESP having an inlet selectively isolated from said annulus depending on the operational condition of said ESP and an outlet in communication with said annulus;

said selective isolation is controlled by a valve;

said valve is operated by a biasing member and is selectively overcome by operation of said ESP;

said valve is open to bypass flow around said ESP from said inlets with said ESP off.

12. The assembly of claim 11, wherein:

said annulus and said inlet are in pressure balance with said ESP off.

13. The assembly of claim 11, wherein:

said housing has at least one external seal to engage a polished bore receptacle on said tubing string.

14. A flow diversion assembly for an electric submersible pump (ESP) supported in a tubular string, comprising:

said ESP supported on a running string for delivery to a predetermined location in said tubular string, said ESP and running string defining an annulus with said tubular string;

said ESP having an inlet selectively isolated from said annulus depending on the operational condition of said ESP and an outlet in communication with said annulus;

said selective isolation is controlled by a valve;

said valve comprises a sliding sleeve;

said inlet comprises housing having a wall port;

said housing sealingly engages the tubular string;

said sliding sleeve disposed in said housing and having a sleeve port in a wall thereof;

said sliding sleeve port selectively aligned with said wall port of said housing;

said sliding sleeve has a closed end adjacent said ESP and a projection located on an opposite side from said sliding sleeve port than said closed end;

said projection engaging a stop on said housing as said sliding sleeve port is misaligned with said wall port of said housing to direct flow through said sliding sleeve port and to said ESP while engagement of said projection to said stop minimizes flow between said housing and said annulus.

15. The assembly of claim 14, wherein:

said sliding sleeve is biased off said housing in a direction that moves said projection away from said stop.

16. The assembly of claim 15, wherein:

operation of said ESP draws said projection toward said stop as said bias is overcome.

17. The assembly of claim 16, wherein:

said housing and said sleeve define an annular path to said ESP through said sliding sleeve port with said projection moved toward said stop.

* * * * *